US005727797A

United States Patent [19]

Bowles

[11] Patent Number: 5,727,797

[45] Date of Patent: Mar. 17, 1998

[54] SNOWBOARD BINDING ASSEMBLY WITH ADJUSTABLE FORWARD LEAN BACKPLATE

[75] Inventor: Craig M. Bowles, Bothell, Wash.

[73] Assignee: Preston Binding Company, Preston, Wash.

[21] Appl. No.: 599,539

[22] Filed: Feb. 6, 1996

[51] Int. Cl.[6] ..... A63C 9/00

[52] U.S. Cl. ..... 280/14.2; 280/626; 280/617

[58] Field of Search ..... 280/617, 623, 280/626, 625, 631, 632, 633, 634, 618, 14.2; 441/70

[56] References Cited

U.S. PATENT DOCUMENTS

| | | | |
|---|---|---|---|
| 4,133,119 | 1/1979 | Kubelka | 36/121 |
| 4,473,235 | 9/1984 | Burt | 280/617 |
| 4,494,939 | 1/1985 | Calapp et al. | 280/623 |
| 4,969,655 | 11/1990 | Katz | 280/14.2 |
| 4,979,760 | 12/1990 | Derrah | 280/633 |
| 5,277,635 | 1/1994 | Gillis | 280/14.2 |
| 5,356,170 | 10/1994 | Carpenter et al. | 280/633 |
| 5,417,443 | 5/1995 | Blattner et al. | 280/14.2 |
| 5,556,123 | 9/1996 | Fournier | 280/633 |
| 5,660,410 | 8/1997 | Alden | 280/617 |

FOREIGN PATENT DOCUMENTS

| | | |
|---|---|---|
| 307745 | 3/1989 | European Pat. Off. . |
| 1932776 | 1/1971 | Germany . |
| 549970 | 4/1974 | Switzerland . |
| 93/14835 | 8/1993 | WIPO . |

*Primary Examiner*—Brian L. Johnson
*Assistant Examiner*—Min Yu
*Attorney, Agent, or Firm*—Seed and Berry LLP

[57] ABSTRACT

A snowboard binding assembly with an adjustable backplate that can be quickly and easily positioned at a desired angle of inclination while on the slopes and without any tools. The binding assembly has a baseplate attachable to the snowboard with a forward end, a rearward end, and a heel brace toward the rearward end shaped to conform to a heel of a rider's boot. A backplate is pivotally mounted to the baseplate to adjust the desired angle of inclination between the backplate and baseplate. A plurality of teeth are positioned on the rear face to form a rack of teeth arranged on the rear face along a longitudinal axis of the backplate, and a movable block is attached to the rear face of the backplate along at least a portion of the rack of teeth so that the block can move along the longitudinal axis of backplate. The block has a front surface facing the backplate with a tooth that mates with the rack of teeth to inhibit upward movement between the block and the backplate along the longitudinal axis of the backplate. The block also has a base that abuttively engages with the heel brace to prevent the backplate from pivoting rearwardly beyond the desired angle of inclination. A quick-release locking mechanism is attached to the backplate for selectively securely engaging the tooth of the block with the rack of the teeth to prevent relative movement between the block and backplate along the longitudinal axis of the backplate. The releasable locking mechanism has an actuator adapted to be gripped by hand and a driver connected to the actuator. The actuator is selectively positionable in a release position to disengage the driver from the block so that the tooth disengages from the rack of the teeth and allows the block to move longitudinally with respect to the backplate. Similarly, the actuator is positionable in a lock position to engage the driver with the block so that the tooth engages the rack of the teeth and secures the block to the backplate against longitudinally upward movement with respect to the backplate.

18 Claims, 3 Drawing Sheets

SNOWBOARD BINDING ASSEMBLY WITH ADJUSTABLE FORWARD LEAN BACKPLATE

TECHNICAL FIELD

The present invention relates to snowboard bindings with pivoting backplates to adjust the forward lean of the backplate with respect to the snowboard.

BACKGROUND OF THE INVENTION

Snowboarding is a winter sport in which riders slide down snow covered slopes on a single, relatively wide board. Snowboards are generally three to five feet long, twelve to eighteen inches wide, and curved upwardly at the tip. The sides of the snowboards also taper inwardly from the tip and tail to the mid section so that each edge has a concave shape with respect to the longitudinal center-line of the board. To mount a snowboard, riders releasably secure their boots to bindings attached to the snowboard. Similar to surfing or skateboarding, a rider mounts a snowboard with the toes of both feet facing to one side of the board (toe-side) and the heels of both feet facing to the other side of the board (heel-side).

A rider controls the snowboard by continuously executing toe-side turns or heel-side turns to keep one of the edges in contact with the snow. To enhance the ability to execute heel-side and toe-side turns, current snowboard bindings have a baseplate attachable to the board and a high backplate pivotally attached to the baseplate so that it can be set at a preselected forward angle relative to the baseplate. The high backplate is shaped to receive the rear portion of a rider's boot. A heel cup is attached to the baseplate, and an adjustable block is attached to the backplate with threaded screws at a location above the heel cup. The high backplate pivots rearward about the baseplate as the snowboard rider leans rearward until the block engages the heel cup. The vertical position of the block on the backplate accordingly limits the angle of inclination between the backplate and the baseplate to be no greater than the preselected forward angle; the lower the block is positioned on the backplate, the further forward the backplate is inclined with respect to the baseplate and the smaller the preselected forward angle. In operation, the preselected forward angle of the backplate can be selected to incline towards the front of the binding to allow the rider to more efficiently set the edges of the board on the snow. Angularly adjustable backplates, therefore, enhance a rider's ability to execute turns and control the snowboard.

One problem with conventional snowboard bindings with pivoting backplates is that it is difficult to quickly and easily adjust the angle of inclination between the backplate and the baseplate, especially when on a snow-covered hill during a short stop. The optimal angle between the backplate and the baseplate is a function of several factors, some of which are as follows: (1) the snow conditions on the slopes; (2) the terrain of a specific run; (3) special maneuvers, such as jumps or sailing off cornices, that a rider performs; and (4) the particular form and ability of the rider. Since the snow conditions, terrain, and special maneuvers often change from one run on a hill to another, snowboarders often want to adjust the position of the block on the backplate between runs or even during a single run. The blocks on conventional bindings, however, are difficult to adjust on the hill because the rider must use a screwdriver or other tool to manipulate the block screws to release the block from the backplate and reposition the block on the backplate. After the rider repositions the block on the backplate, the rider must again use a tool to manipulate the block screws to re-attach the block to the backplate. It will be appreciated that it is inconvenient to carry a tool out on the slopes, and it is often painful to handle a tool bare-handed in cold, icy conditions. Most snowboarders, accordingly, do not adjust the angle of the backplate as often as they would like. Thus, to optimize the performance of snowboards, it would be desirable to develop a snowboard binding with an adjustable backplate that can be quickly and easily adjusted while on the slopes without tools and without removing the boot from the binding.

SUMMARY OF THE INVENTION

The present invention is a snowboard binding assembly with an adjustable backplate that can be quickly and easily positioned at a desired angle of inclination without using any tools. The binding assembly has a baseplate attachable to the snowboard with a forward end, a rearward end, and a heel brace toward the rearward end shaped to conform to a heel of a rider's boot. A backplate is pivotally mounted to the baseplate to adjust the desired angle of inclination between the backplate and the baseplate. The backplate has a rear face generally facing towards the heel brace, and a plurality of teeth positioned on the rear face to form a rack of teeth arranged on the rear face along a longitudinal axis of the backplate. Each tooth in the rack of teeth extends substantially transversely to the longitudinal axis of the backplate.

A movable block is attached to the rear face of the backplate along at least a portion of the rack of teeth so that the block can move along the longitudinal axis of backplate. The block has a front surface facing the backplate with a tooth that mates with the rack of teeth to inhibit upward movement between the block and the backplate along the longitudinal axis of the backplate. The block also has a base that abuttively engages the heel brace to prevent the backplate from pivoting rearwardly beyond the desired angle of inclination.

A quick-release locking mechanism is attached to the backplate for selectively engaging the tooth of the block with the rack of the teeth to prevent relative movement between the block and backplate along the longitudinal axis of the backplate. The releasable locking mechanism has an actuator adapted to be gripped by hand and a driver connected to the actuator. The driver engages the block to securely engage the tooth of the block with the rack of teeth. The actuator is selectively positionable in a release position to disengage the driver from the block so that the tooth disengages from the rack of the teeth and allows the block to move longitudinally with respect to the backplate. Similarly, the actuator is positionable in a lock position to engage the driver with the block so that the tooth engages the rack of the teeth and secures the block to the backplate against longitudinally upward movement with respect to the backplate. The maximum angle of inclination of the backplate relative to the baseplate is selectively adjusted by positioning the actuator in the release position, moving the block along the longitudinal axis of the backplate to a desired location over the rack of teeth, and re-positioning the actuator in the lock position.

DETAILED DESCRIPTION OF THE INVENTION

The present invention is a snowboard binding with an adjustment mechanism that may be gripped by hand and operated without using tools to provide quick and easy adjustment of an angle of forward inclination between the backplate and the baseplate. An important aspect of the invention is a quick-release locking mechanism that has an actuator adapted to be gripped by hand, and a driver connected to the actuator. The actuator may be moved between a release position and a lock position without removing protective hand gloves or using tools. Importantly, the angle of inclination between the backplate and the baseplate is adjusted by positioning the actuator in the release position, moving the block to a desired location, and then simply repositioning the actuator in the lock position. Accordingly, snowboarders can quickly and easily adjust the inclination of the backplate while on the slopes, and without removing their boots from the bindings, to optimize the performance of their snowboards. FIGS. 1–7, in which like reference numbers refer to like parts throughout the various figures, illustrate a snowboard binding assembly in accordance with the invention.

Figure 1:
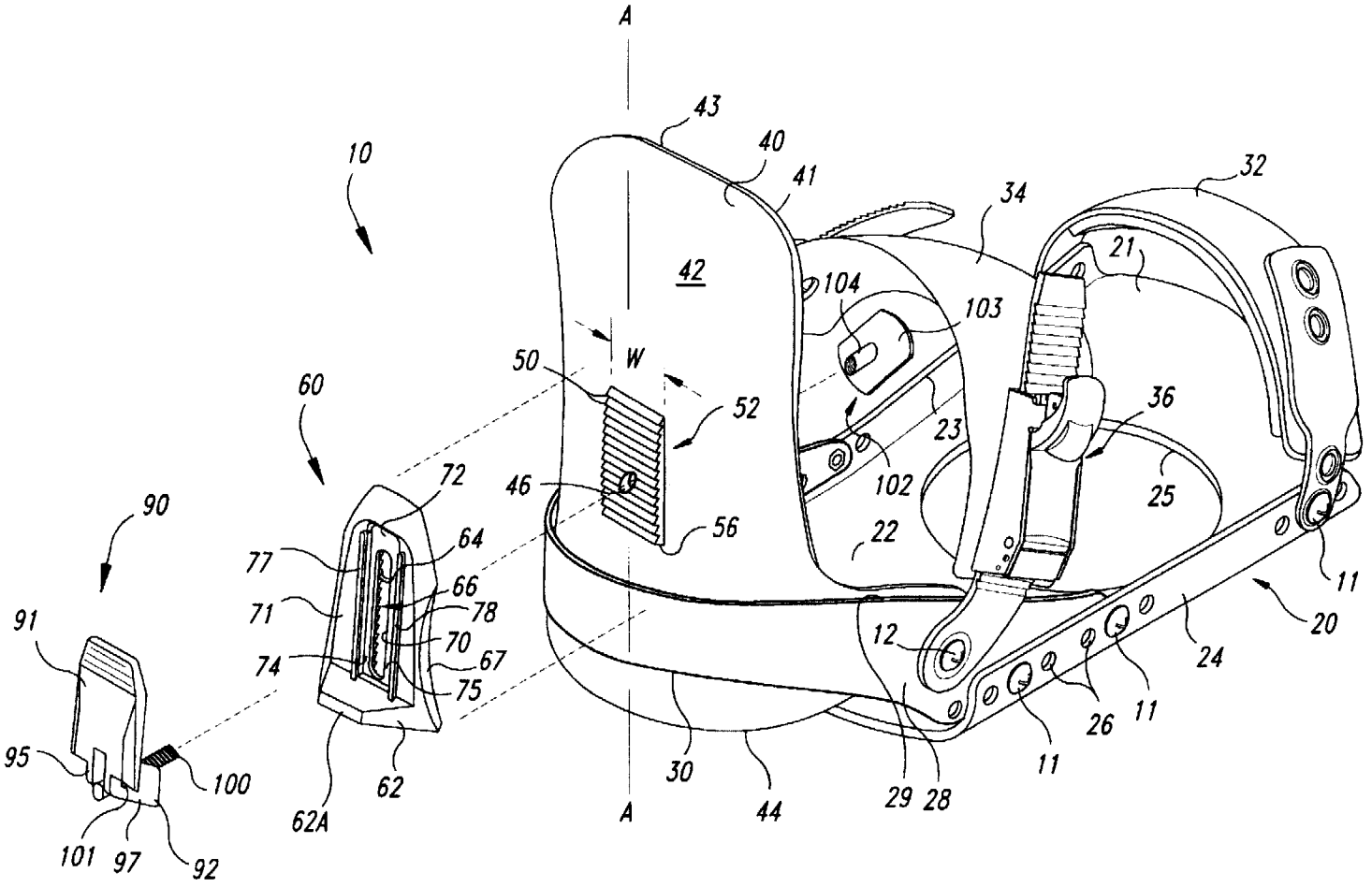
FIG. 1 is an isometric view of a snowboard binding assembly in accordance with the invention.

FIG. 1 illustrates a snowboard binding assembly 10 that has a baseplate 20 with a forward end 21, a rearward end 22, left and right sides 23 and 24, respectively, extending between the forward end 21 and rearward end 22, and a heel brace 28. The heel brace 28 extends substantially rearwardly from the rearward end 22 in an arc between the left side 23 and the right side 24. A number of holes 26 are preferably positioned in the left and right sides 23 and 24, by which the heel brace 28 is movably attached to the left and right sides 23 and 24 by a number of screws 11. Alternatively, the heel brace 28 may be formed integrally with the baseplate 20 toward its rearward end 22. A toe strap 32 is movably attached to the baseplate 20 at the forward end 21, and an adjustable ankle strap 34 is attached to the baseplate 20 either at the rearward end 22 or the heel brace 28. The ankle strap 34 has a buckle 36 for drawing the ankle strap against a boot (not shown) of a rider positioned in the binding assembly 10 atop the baseplate 20. The binding assembly 10 is mounted to a snowboard (not shown) by a mounting plate (not shown) attached thereto and positioned in a large central opening 25 through the bottom of the baseplate 20.

A backplate 40 is pivotally attached to the baseplate 20, and preferably to the heel brace 28 (as shown in FIG. 1), by left and right side pivot screws 12. The backplate 40 pivots with respect to the baseplate 20 about an axis of rotation extending through the left and right side screws 12 so that the angle of forward inclination between the backplate 40 and the baseplate 20 may be adjusted to obtain a desired angle of inclination that optimizes the performance of the snowboard when the rider leans rearward. The backplate 40 has a front face 41 generally facing towards the forward end 21 of the baseplate 20 to receive and engage the upper portion of a rider's boot, and a rear face 42 generally facing rearward towards the heel brace 28. The backplate 40 preferably has an upper edge 43 positioned substantially above a top rim 29 of the heel brace 28, and a bottom edge 44 positioned below a lower edge 30 of the heel brace 28. A plurality of teeth 50 are positioned on the rear face 42 of the backplate 40 to form a rack of teeth 52 arranged on the rear face 42 along a longitudinal axis A—A of the backplate 40 indicated by the line A—A in FIG. 1. The teeth 50 extend substantially transversely to the longitudinal axis A—A of the backplate 40 to define the width W of the rack of teeth 52. In operation, the rack of teeth 52 provides a surface that inhibits a movable block 60 of the binding assembly from moving longitudinally with respect to the backplate 40 along the axis A—A, as will be discussed in detail below. A hole 46 extends through the backplate 40 at a generally mid-portion of the rack of teeth 52.

Figure 2:
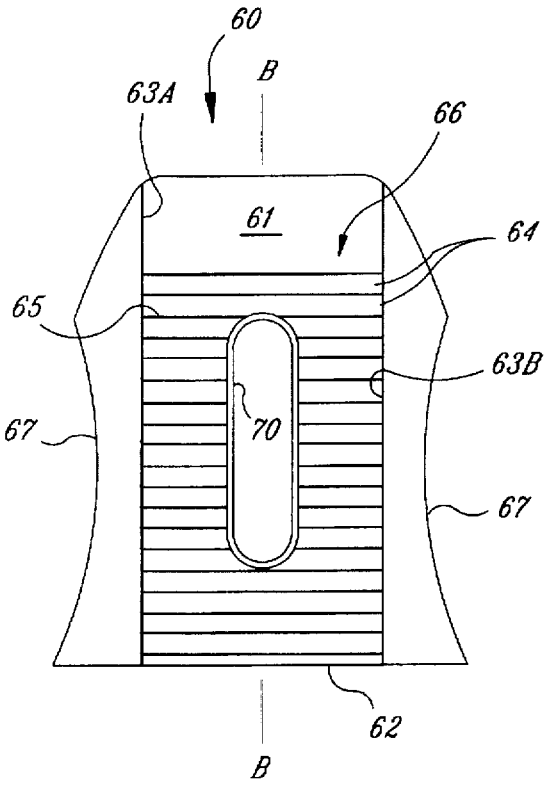
FIG. 2 is a front elevational view of a movable block used in the snowboard binding assembly of FIG. 1.
Figure 3:
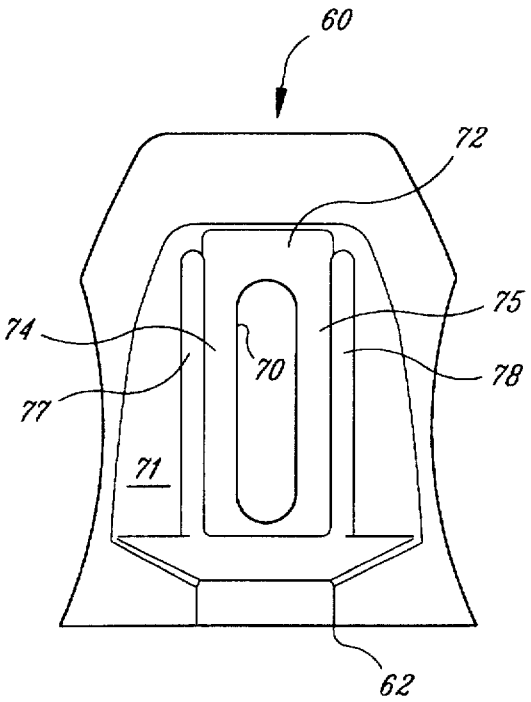
FIG. 3 is a rear elevational view of the movable block of FIG. 2.

The movable block 60 is best illustrated in FIGS. 1–3. When assembled, the block 60 is attached to the rear face 42 of the backplate 40 so that it is selectively movable along the rack of teeth 52 to a desired position. As shown in FIG. 2, the block 60 has a front face 61 with first and second shoulders 63A and 63B spaced apart from one another by a distance slightly greater than the width of the teeth 50 on the backplate 40. The first and second shoulders 63A and 63B guide the longitudinal movement of the block 60 along the longitudinal axis A—A of the backplate 40 over the rack of teeth 52. Additionally, the first and second shoulders 63A and 63B prevent undesired transverse movement and rotational movement between the block 60 and the backplate 40 with respect to the longitudinal axis of the backplate 40. A number of teeth 64 are positioned on the front face 61 of the block 60 to form a rack of teeth 66 arranged on the front surface 61 along a longitudinal axis B—B of the block 60. The teeth 64 of the block 60 have an opposing slope to the teeth 50 of the backplate to mate with the teeth 50 such that a number of flat-locking surfaces 65 on the teeth 64 abut an equal number of flat-locking surfaces 56 of the teeth 50. The flat locking surfaces 56 of the teeth 50 face downwardly and the flat locking surfaces 65 of the teeth 64 face upwardly; thus, when the teeth 64 and teeth 50 mate with one another, they inhibit upward movement of the block 60 relative to the backplate 40 along the longitudinal axis A—A of the backplate. The teeth 50 and 64 also have inclined surfaces to allow the block 60 to slide downwardly along the longitudinal axis A—A when the flat locking surfaces 56 and 65 of the teeth 50 and the teeth 64 are disengaged from one another.

The block 60 also has a base 62 at its lower end positioned and sized to engage the top rim 29 of the heel brace 28 and prevent the backplate 40 from pivoting rearwardly beyond the desired angle of forward inclination between the backplate 40 and baseplate 20. The base 62 includes a flange portion 62A that projects rearward from the block 60 and over the top rim 29 of the heel brace 28, but the base 62 may have other shapes as well. Left and right side opposing hand grips 67 are formed along the sides of the block 60. The grips 67 have a concave shape with respect to the center-line B—B of the block 60, but alternatively may have a roughened surface to enhance the ability of the snowboard rider to grip the block 60. An elongated slot 70 formed through the block 60 extends along the longitudinal axis B—B of the block from a lower portion of the block 60 to an upper portion of the block 60. As the block 60 is moved longitudinally along the longitudinal axis A—A of the backplate 40 to position the block 60 so that the teeth 64 engage the teeth 50 of the backplate 40, the first and second shoulders 63A and 63B hold the block in position over the rack of teeth 52 with the slot 70 aligned with the hole 46 in the backplate 40.

In other embodiments, a plurality of pins or other protrusions may be positioned on the rear face 42 of the backplate 40 instead of the teeth 50. In still other embodiments, a plurality of depressions or holes may be positioned on the rear face instead of protrusions. Correspondingly, a plurality of pins, holes, depressions, or protrusions may be positioned at the front face 61 of the block 60 instead of the teeth 64. Importantly, the features formed on the rear face 42 of the backplate 40 are selected to mate with the features formed on the front face 61 of the block 60 to inhibit movement between the block 60 and backplate 40 along the longitudinal axis A—A of the backplate 40.

FIGS. 1 and 3 best illustrate a rear surface 71 of the block 60. The rear surface 71 has an elongated recess 72 within which the slot 70 is located, and first and second rails 77 and 78 spaced from opposing sides of the slot 70 to define the elongated sides of the recess 72. The recess 72 has a first pad 74 located between the first rail 77 and the slot 70, and a second pad 75 positioned between the second rail 78 and the other side of the slot 70. As discussed below, the pads 74 and 75 provide a surface upon which a quick-release locking mechanism acts to drive the block 60 firmly against the backplate 40 during use of the snowboard binding 10 by the rider. In operation, the rails 77 and 78 help guide the quick-release mechanism into proper orientation with respect to the pads 74 and 75.

A quick-release locking mechanism 90, illustrated in FIG. 1, drives and holds the teeth 64 on the block 60 against the teeth 50 on the backplate 40 to prevent longitudinal movement between the block 60 and the backplate 40, especially upward movement of the block 60 relative to the backplate 40. The locking mechanism 90 has a hand-operable actuator 91 and a driver 92 connected to the actuator 91. Importantly, the actuator 91 may be easily gripped and operated by a person's hand without using any tools and while wearing a glove. In the illustrated embodiment, the actuator 91 is a lever and the driver 92 is a cam with first and second cam lobes 95 and 97, respectively. A threaded stud 100 is pivotally connected between the first and second cam lobes 95 and 97 by a pivot pin 101 received in a hole 98 (shown in FIGS. 4 and 5) in each cam lobe.

The locking mechanism 90 also has a nut 102 with a foot 103 and an interiorly threaded sleeve 104 attached to the foot 103. The sleeve 104 is positioned within the hole 46 in the backplate 40 to align the threads of the sleeve 104 so that they can threadably receive a threaded end portion of the stud 100. The stud 100 and the nut 102 couple the actuator 91 and the driver 92 to the backplate 40 and they position the driver 92 with respect to the block 60 so that the driver 92 can drive and hold the block 60 against the backplate 40. The rails 77 and 78 are spaced apart from one another by a distance slightly greater than the width of the cam 92 to prevent the cam 92 from rotating about the longitudinal axis of the stud 100 when the cam is positioned between the rails. The foot 103 of the locking mechanism 90 is positioned at the front face 41 of the backplate 40, and the foot 103 is sized larger than the hole 46 to prevent the sleeve 104 and the foot 103 from being pulled rearwardly through the hole 46.

Figure 4:
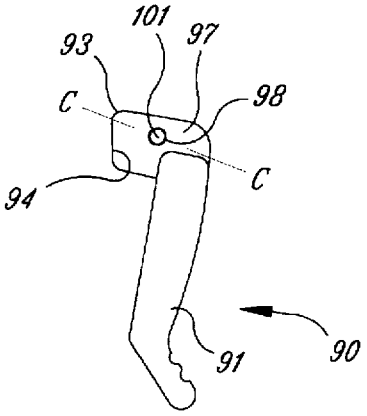
FIG. 4 is a side elevational view of a lever and cam driver used in the snowboard binding assembly of FIG. 1.
Figure 5:
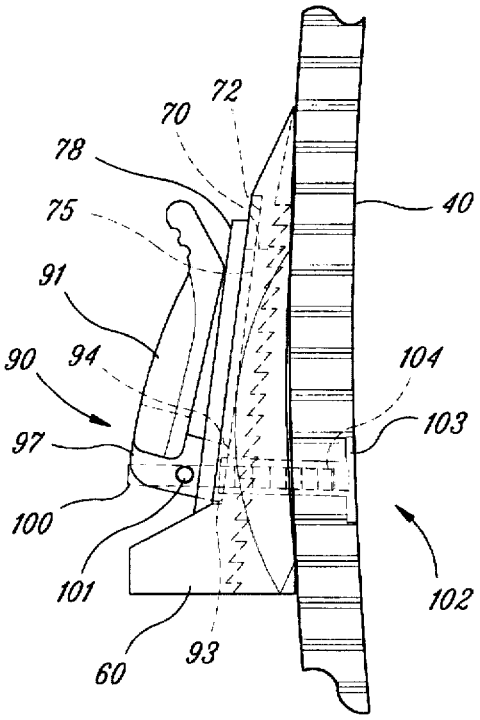
FIG. 5 is a side elevational view of a lever and cam driver engaged with the movable block of the snowboard binding assembly of FIG. 1 shown in a lock position.

FIGS. 4 and 5 illustrate the operation of the locking mechanism 90 with respect to the block 60 and the backplate 40. Referring to FIG. 4, the hole 98 in the second cam lobe 97 is shown receiving the pin 101 on which the stud 100 is pivoted. A radius 93 is positioned off center with respect to a fulcrum axis C—C, and a flat contact face 94 is positioned at an acute angle with respect to the fulcrum axis C—C. It will be appreciated that the first cam lobe 95 is identical to the second cam lobe 97. FIG. 5 illustrates the locking mechanism 90 in a locked position in which the block 60 is securely engaged with the backplate 40 to prevent relative longitudinal movement therebetween. The stud 100 is threadedly positioned within the threaded sleeve 104 so that the radius 93 of the second cam lobe 97 engages the second pad 75 of the recess 72 on the rear surface 71 of the block 60. Similarly, while not visible in FIG. 5, the radius of the first cam lobe 95 engages the first pad 74 of the recess 72. As the lever 91 is moved by the snowboard rider downwardly towards the rails 77 and 78, the radii 93 of the first and second cam lobes 95 and 97 drive the block 60 against the backplate 40 until the fulcrum axis C—C passes across the first and second pads 74 and 75. The stud 100 is threadably rotatable within the threaded sleeve 104 to selectively space the pin 101 away from the recess 72 by a distance that creates a significant amount of tension in the stud 100 and thus drives the block 60 securely against the backplate 40 when the lever 91 is moved downwardly. In a preferred embodiment, the top surfaces of the rails 77 and 78 are positioned to prevent the stud 100 from being rotated too far into the threaded sleeve 104 and thereby establish a position for the stud within the sleeve at which the tension in the stud 100 drives the block 60 against the backplate 40 with an appropriate force.

After the fulcrum axis C—C passes over the first and second pads 74 and 75, the tension in the stud 100 snaps the contact surfaces 94 of the first and second cam lobes 95 and 97 into engagement with the corresponding one of the first and second pads 74 and 75 of the recess 72. By forming the contact surfaces 94 at an acute angle with respect to the fulcrum axis C—C, the tension in the stud 100 holds the lever 91 of the locking mechanism 90 securely against the block 60 to lock the block 60 against the backplate 40. In this position, unintentional releasing movement of the lever 91 is inhibited.

In another embodiment not shown, the driver 92 may be a ram (not shown) biased downwardly against the recess 72 of the block 60 by a spring (not shown), and the actuator 91 may be a first flange (not shown) formed on one side of the ram and a second flange (not shown) formed on another side of the ram. In operation, the spring is placed under tension to draw the ram against the block 60 and urge the block 60 into engagement with the backplate 40. To move the block 60 with respect to the backplate 40, the rider grips the flanges and pulls the ram away from the block 60. The block 60 may then be moved with respect to the backplate 40 to position the face 62 at a desired location, as discussed above. The block 60 may be re-engaged with the backplate 40 by simply releasing the flanges to allow the spring to again draw the ram against the block 60.

Figure 7:
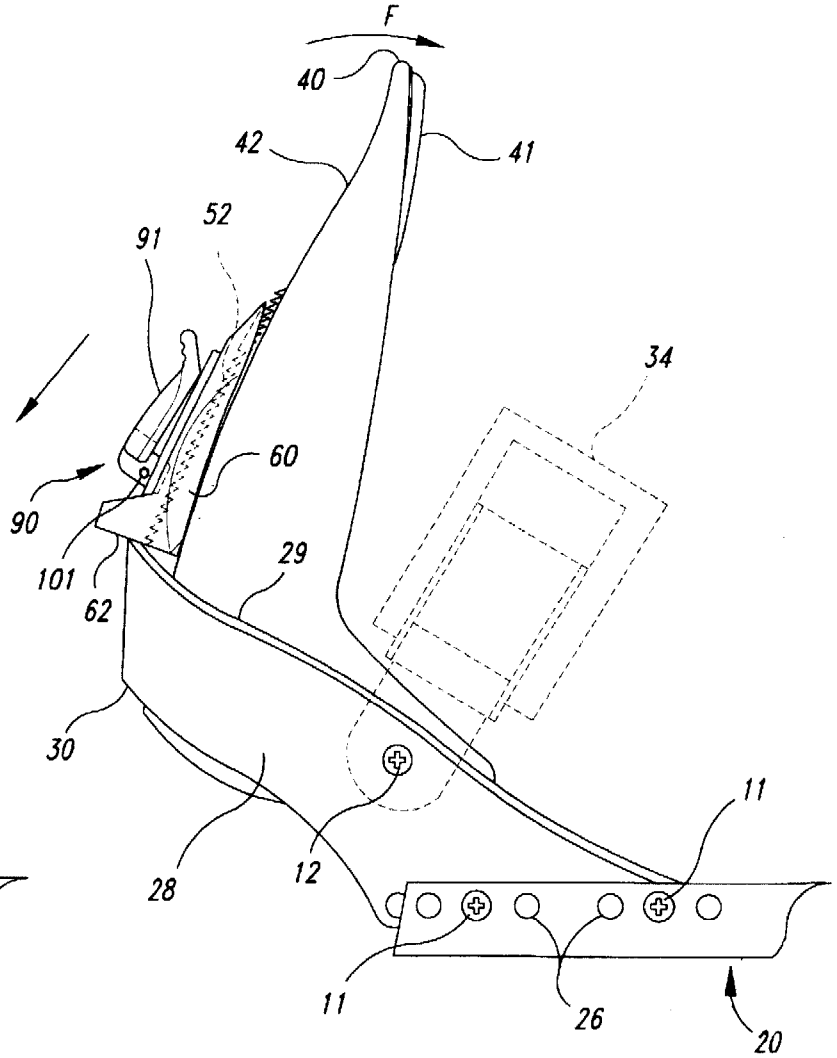
FIG. 7 is a fragmentary, side elevational view of the snowboard binding assembly of FIG. 6 in which the backplate is positioned at another angle of forward inclination with a smaller forward inclination angle for greater lean control.
Figure 6:
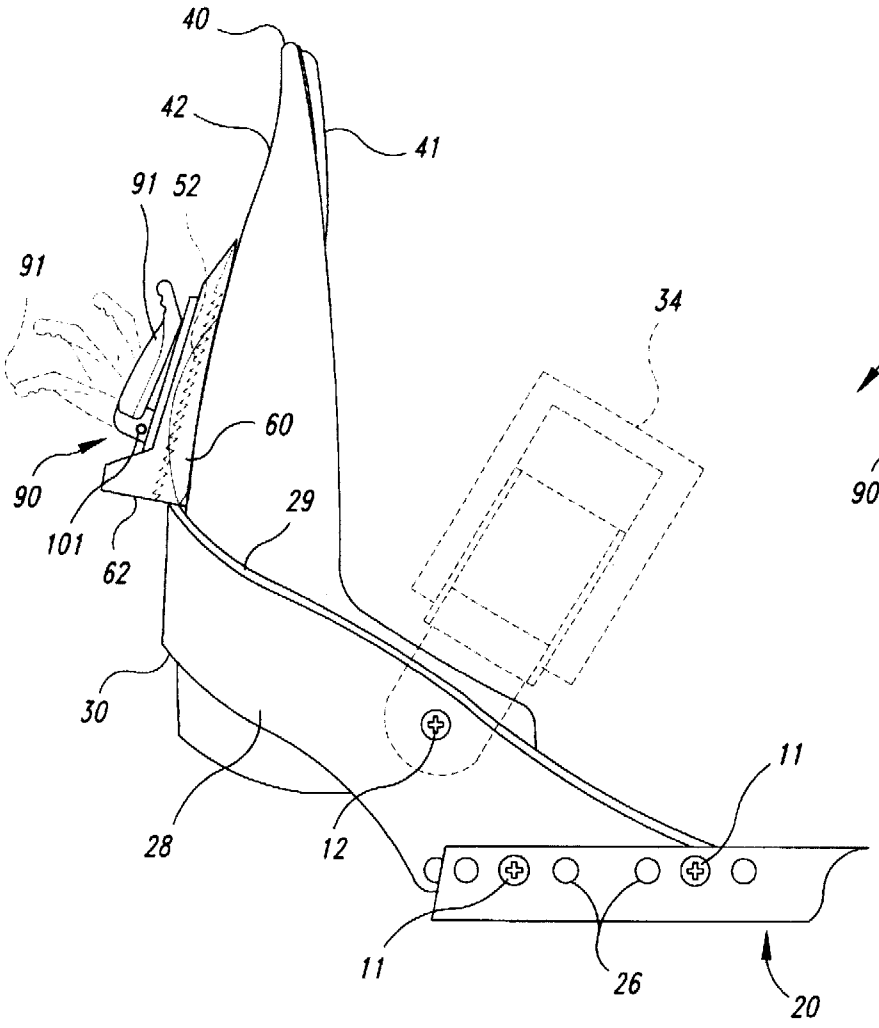
FIG. 6 is a fragmentary, side elevational view of the snowboard binding assembly of FIG. 1 in which the backplate is positioned at one angle of inclination.

FIGS. 6 and 7 illustrate the complete operation of the binding assembly 10 shown in FIGS. 1–5. FIG. 6 illustrates the backplate 40 in a substantially upright position in which the block 60 is positioned towards the top of the rack of teeth 52 on the rear face 42 of the backplate 40. The locking mechanism 90 is in the lock position so that the block 60 is pressed firmly against the backplate 40 to prevent movement therebetween along the longitudinal axis of the backplate 40 (especially in the upward direction as tends to result when the snowboard rider leans rearward in the binding assembly to pivot the backplate 40 rearward and drive the block 60 into hard engagement with the top rail 29 of the heel brace 28). The base 62 of the block 60 engages the top rim 29 of the heel brace 28 and prevents the backplate 40 from pivoting rearwardly towards the heel brace 28. The block 60 accordingly prevents the forward inclination angle between the backplate 40 and the baseplate 20 from increasing beyond that angle selected by adjustment of the position of the block 60 on the backplate 40, as described above.

To move the block 60 to a different location with respect to the rear face 42 of the backplate 40, the rider grabs the actuator 91 by his or her hand and pivots the actuator 91 about the pin 101 by moving it away from the backplate 40 to a release position (shown in phantom in FIG. 6). Referring to FIG. 7, the backplate 40 is pivoted forward towards the forward end of the baseplate 20, as shown by arrow F, and the block 60 is moved downward with respect to the backplate 40. Once the block 60 is positioned at a desired location, the rider pivots the actuator 91 about the pin 101 until the actuator snaps into the lock position.

The present invention is advantageous because the angle of forward inclination between the backplate 40 and the baseplate 20 may be adjusted quickly and conveniently without using any tools. By providing a hand-operated locking mechanism that may be gripped with a gloved hand, snowboard riders can adjust the angle of forward inclination by merely grasping the actuator 91 and moving it between a lock position and a release position. Therefore, compared to conventional snowboard binding assemblies, it is faster and easier to adjust the angle of forward inclination between the backplate 40 and the baseplate 20 and achieve adjustable lean control using the snowboard binding assembly 10 of the present invention.

It will be appreciated that, although specific embodiments of the invention have been described herein for purposes of illustration, various modifications may be made without departing from the spirit and scope of the invention. Accordingly, the invention is not limited except as by the appended claims.

I claim:

1. An adjustable snowboard binding for securing a boot to a snowboard, comprising:

a base member adapted to be mounted to the snowboard, the base member having a forward end and a rearward end;

a back support pivotally mounted to the base member to adjust an angle of forward inclination between the back support and the base member, the back support having a rearward facing rear face;

a moveable block attached to the rear face of the back support and adapted to be selectively positioned along a path of travel over the rear face of the back support to prevent the back support from pivoting rearwardly beyond a desired maximum angle of forward inclination, wherein the block is selectively mateable with the back support along the path of travel to releasably lock the block to the back support and prevent relative movement therebetween along the path of travel; and a quick-release lock mechanism attached to the back support for selectively and securely mating the block with the back support to prevent relative movement therebetween along the path of travel, the quick-release lock mechanism being selectively positionable in a release position to disengage the block from the back support and allow the block to move with respect to the back support along the path of travel, and the quick-release lock mechanism being selectively re-positionable in a lock position to mate the block with the back support and prevent movement therebetween along the path of travel, whereby the maximum angle of forward inclination of the back support is selectively adjusted by positioning the quick-release lock mechanism in the release position, moving the block along the path of travel to a desired location, and re-positioning the quick-release lock mechanism in the lock position.

2. The snowboard binding of claim 1:

wherein one of the rear face of the back support and a front face of the block has a plurality of protrusions positioned thereon and arranged along the path of travel; and wherein the other of the rear face of the back support and the front surface of the block has at least one depression adapted to mate with the protrusions of the rack of protrusions, whereby a protrusion of the rack of protrusions engages the at least one depression in the lock position to prevent relative movement between the block and the back support along the path of travel, and further whereby the engaged protrusion disengages the at least one depression in the release position to allow the block to move over the back support along the path of travel.

3. The snowboard binding of claim 2 wherein the protrusions are on the rear face of the back support and comprise pins, and the at least one depression is on the from surface of the block and comprises a hole adapted to receive one of the pins.

4. The snowboard binding of claim 2 wherein the protrusions are on the rear face of the back support and comprise a plurality of teeth positioned on the rear face to form a rack of teeth arranged on the rear face along the longitudinal axis of the back support, each tooth extending substantially transversely to the longitudinal axis of the back support, and wherein the at least one depression is on the front surface of the block and comprises a plurality of grooves defined by a plurality of teeth on the front surface of the block that form a rack of teeth on the block.

5. The snowboard binding of claim 2 wherein the block further comprises first and second shoulders on the front surface to align the block with the rack of teeth of the back support and to inhibit transverse movement between the block and the back support along the longitudinal axis of the back support.

6. The snowboard binding of claim 2 wherein the locking mechanism further comprises a stud projecting away from the rear face of the back support, the driver being pivotally attached to the stud to allow a rider to grip the actuator and rotate the driver in one direction from a release position into engagement with the block thereby driving the block against the back support until the block and the back support lock together in the lock position against relative movement therebetween along the longitudinal axis of the back support, and to further allow the rider to rotate the driver from the lock position in another direction disengaging the driver from the block thereby releasing the block from the back support in the release position to allow relative movement therebetween along the longitudinal axis of the back support.

7. The snowboard binding of claim 5 wherein the block further comprises an elongated slot extending through the block along an axis substantially parallel to the longitudinal axis of the back support, the stud being received in the slot so that the block is selectively moveable along the longitudinal axis of the back support until the stud engages an end of the slot.

8. The snowboard binding of claim 7 wherein the block further comprises a rear surface generally facing away from the back support with an elongated recess adjacent to the slot, the driver engaging the elongated recess to drive the block into engagement with the back support in the lock position.

9. The snowboard binding of claim 6 wherein the actuator is a lever adapted to be gripped by a gloved hand and the driver is a cam with a first cam lobe pivotally attached to one side of the stud and a second cam lobe pivotally attached to an opposite side of the stud, each cam lobe having a radius and a contact face so that the radii of the cam lobes engage the block as the lever rotates the cam lobes about the stud to drive the block into the lock position against the back support in which the contact faces engage the block and lock the block and back support together against relative movement therebetween along the longitudinal axis of the back support.

10. An adjustable snowboard binding for securing a boot to a snowboard, comprising:

a base member attachable to the snowboard, the base member having a forward end, a rearward end, and a stop positioned toward the rearward end;

a back support having a lower end portion and an upper end portion with a longitudinal axis extending therebetween, the back support being pivotally mounted to the base member to adjust an angle of forward inclination between the back support and the base member, the back support having a rearward facing rear face;

a movable block attached to the rear face of the back support and adapted to be selectively movable relative to the back support along the longitudinal axis of the back support, wherein one of the rear face of the back support and a front surface of the block has a plurality of teeth positioned thereon to form a rack of teeth arranged along a rack axis substantially parallel to the longitudinal axis of the back support with each tooth extending substantially transverse to the rack axis, and wherein the other of the rear face of the back support and the front surface of the block has at least one tooth mateable with the rack of teeth to inhibit movement between the block and the back support along the longitudinal axis of the back support, the block having a base abuttively engageable with the stop to prevent the back support from pivoting rearwardly beyond a maximum desired angle of forward inclination; and a quick-release locking mechanism attached to the back support and operable to selectively securely engage the at least one tooth with the rack of teeth to prevent relative movement between the block and the back support along the longitudinal axis of the back support, the quick-release locking mechanism having an actuator adapted to be gripped by hand and a driver connected thereto, the driver being engageable with the block, the actuator being selectively positionable in a release position to disengage the driver from the block so that the at least one tooth disengages from the rack of teeth and allows the block to move longitudinally with respect to the back support, and the actuator being further selectively positionable in a lock position to engage the driver with the block so that the at least one tooth engages the rack of teeth and secures the block to the back support against longitudinal upward movement along the longitudinal axis of the back support, whereby the maximum desired angle of forward inclination of the back support is selectively limited by positioning the actuator in the release position, moving the block along the longitudinal axis of the back support to a desired location, and repositioning the actuator in the lock position.

11. The snowboard binding of claim 1:

wherein the block further comprises first and second shoulders on the front surface to maintain the block aligned with the longitudinal axis of the back support and to inhibit transverse movement between the block and the back support with respect to the longitudinal axis of the back support; and wherein the rack of teeth is on the rear face of the back support and the at least one tooth is on the front surface of the block and comprises a plurality of teeth extending between the first and second shoulders to form a rack of teeth on the front surface of the block mateable with the rack of teeth on the rear face of the back support.

12. The snowboard binding of claim 1 wherein the block has first and second sides, the first and second sides opposing one another to form hand-grips on the block.

13. The snowboard binding of claim 1 wherein the stop is a heel brace releasably attached to the rearward end of the base member to adjust the position of the heel brace along a longitudinal axis of the base member, the heel brace projecting generally upwardly from the snowboard.

14. The snowboard binding of claim 1 wherein the locking mechanism further comprises a stud projecting away from the rear face of the back support, the driver being pivotally attached to the stud to allow a rider to grip the actuator and rotate the driver in one direction from the release position into engagement with the block thereby driving the block against the back support until the block and the back support lock together in the lock position against relative movement therebetween along the longitudinal axis of the back support, and to further allow the rider to rotate the driver from the lock position in another direction disengaging the driver from the block thereby releasing the block from the back support in the release position to allow relative movement therebetween along the longitudinal axis of the back support.

15. The snowboard binding of claim 14 wherein the block further comprises an elongated slot extending through the block along an axis substantially parallel to the longitudinal axis of the back support, the stud being received in the slot so that the block is selectively moveable along the longitudinal axis of the back support until the stud engages an end of the slot.

16. The snowboard binding of claim 15 wherein the block further comprises a rear surface generally facing away from the back support with an elongated recess adjacent to the slot, the driver engaging the elongated recess to drive the block into engagement with the back support in the lock position.

17. The snowboard binding of claim 14 wherein the actuator is a lever adapted to be gripped by a gloved hand and the driver is a cam with a first cam lobe pivotally attached to one side of the stud and a second cam lobe pivotally attached to an opposite side of the stud, each cam lobe having a radius and a contact face so that the radii of the cam lobes engage the block as the lever rotates the cam lobes about the stud to drive the block into the lock position against the back support in which the contact faces engage the block and lock the block and back support together against relative movement therebetween along the longitudinal axis of the back support.

18. An adjustable snowboard binding for securing a boot to a snowboard, comprising:

a base member attachable to the snowboard, the base member having a forward end and a rearward end with a longitudinal axis extending therebetween, and first and second sides extending between the forward and rearward ends;

a heel brace positioned toward the rearward end of the base member and shaped to conform to a heel of the boot, the heel brace extending between the first and second sides and projecting generally upwardly and rearwardly from the first and second sides, the heel brace having a top rim positioned between the first and second sides, the heel brace being releasably attached to the base member to adjust the position of the heel brace with respect to the longitudinal axis of the base member;

a back support having a lower end portion and an upper end portion with a longitudinal axis extending therebetween, the lower end portion of the back support being pivotally attached to the heel brace to adjust the angle between the back support and the base member to an angle of forward inclination, the back support having a forward facing front face, a rearward facing rear face, a plurality of teeth extending substantially transverse to the longitudinal axis of the back support for a transverse distance and being positioned on the rear face to form a rack of teeth arranged on the rear face along the longitudinal axis of the back support, and a hole through the back support positioned in the rack of teeth to provide access through the back support;

a movable block attached to the rear face of the back support along the rack of teeth to selectively move along the longitudinal axis of the back support, the block having a front surface facing the back support with first and second shoulders spaced apart from one another by approximately the transverse distance of the teeth on the back support to prevent transverse movement between the block and the back support with respect to the longitudinal axis of the back support, and a plurality of teeth on the front surface extending between the first and second shoulders to form a rack of teeth on the block mateable with the rack of teeth on the back support to inhibit movement between the block and back support along the longitudinal axis of the back support, the block further including a base abuttively engageable with the top rim of the heel brace to prevent the back support from pivoting rearwardly beyond a maximum desired angle of forward inclination, an elongated slot through the block having first and second sides extending substantially parallel to the longitudinal axis of the back support to provide access to the back support through the block, a rear surface facing generally towards the heel brace with first and second rails extending substantially parallel to the first and second sides of the slot and being spaced away from the first and second sides of the slot, respectively, and an elongated recess with a first pad located between the first rail and the first side of the slot and a second pad located between the second rail and the second side of the slot; and a quick-release locking mechanism attached to the back support and operable to securely engage the rack of teeth on the block with the rack of teeth on the back support to prevent upward movement between the block and back support along the longitudinal axis of the back support, the quick-release locking mechanism having an actuator adapted to be grasped and operated by a gloved hand so that a rider can move the actuator between a release position and a lock position without using tools, a cam having a first cam lobe connected to one side of the lever and a second cam lobe connected to the other side of the lever to define a gap between the first and second cam lobes, each cam lobe having a radius and a contact face for driving and holding the block against the back support, a stud positioned in the gap between the first and second cam lobes, the cam being pivotally attached to the stud and rotated about the stud into engagement with the first and second pads of the elongated recess on the block in response to movement of the actuator, and a member having a foot abutting the front face of the back support and a threaded sleeve attached to the foot and extending through the hole in the back support and aligned with the slot in the block, the stud being threadedly attached to the sleeve to position the radii of the first and second cam lobes in engagement with the first and second pads, respectively, of the recess as the actuator moves from the release position to the lock position to rotate the cam about the stud and drive the block against the back support until the first and second contact faces of the first and second cam lobes engage the first and second pads, respectively, and hold the block against the back support to prevent movement therebetween along the longitudinal axis of the back support when the actuator is in the lock position.

* * * * *